US005328050A

United States Patent [19]

Hyatt

[11] Patent Number: 5,328,050

[45] Date of Patent: Jul. 12, 1994

[54] DUAL NESTED LIQUID CONTAINER

[76] Inventor: Donnie L. Hyatt, 331 W. Jonesville Rd., Bowdon, Ga. 30108

[21] Appl. No.: 66,591

[22] Filed: May 24, 1993

[51] Int. Cl.[5] ..... B67D 5/56

[52] U.S. Cl. ..... 220/506; 222/129

[58] Field of Search ..... 220/506, 23.83, 23.86, 220/DIG. 10, 661, 367; 215/6, ; 222/129

[56] References Cited

U.S. PATENT DOCUMENTS

| | | | |
|---|---|---|---|
| 217,133 | 7/1879 | Meinen | 222/129 X |
| 501,007 | 7/1893 | Green | 222/129 X |
| 700,005 | 5/1902 | Armstrong | 222/129 |
| 1,607,347 | 11/1926 | Hemman | 222/129 X |
| 2,624,451 | 1/1953 | Ewing | 220/506 X |
| 2,788,919 | 4/1957 | Bostwick | 222/129 |
| 4,526,797 | 7/1985 | Stone, Jr. | 220/367 X |
| 4,548,339 | 10/1985 | Gorman | 220/506 X |
| 4,715,186 | 12/1987 | Ishimaru et al. | 220/506 X |
| 4,932,563 | 6/1990 | Diamond, et al. | 222/129 |

FOREIGN PATENT DOCUMENTS

| | | | |
|---|---|---|---|
| 2159490 | 12/1985 | United Kingdom | 220/506 |

*Primary Examiner*—Steven M. Pollard
*Attorney, Agent, or Firm*—S. Michael Bender

[57] ABSTRACT

A new and improved dual nested liquid container includes an outer container assembly which includes an outer vessel and an outer dispensing valve assembly which projects outward from the outer vessel. An inner container assembly is nested within the outer vessel. The inner container assembly includes an inner vessel and an inner dispensing valve assembly which projects outward from both the inner container assembly and the outer vessel. A lid assembly includes an inner lid portion and an outer lid portion. The inner lid portion provides coverage for the inner vessel, and the outer lid portion provides coverage for the outer vessel. The inner lid portion is nested within the outer lid portion. An outer connector assembly is connected between the outer container assembly and the outer lid portion for removably connecting the outer lid portion to the outer container assembly. Similarly, an inner connector assembly is connected between the inner container assembly and the inner lid portion for removably connecting the inner lid portion to the inner container assembly. The inner lid portion includes an inner vent hole for venting the inner container assembly when liquid is dispensed from the inner container assembly through the inner dispensing valve assembly. Similarly, the outer lid portion includes a first outer vent hole for venting the outer container assembly when liquid is dispensed from the outer container assembly through the outer dispensing valve assembly.

11 Claims, 4 Drawing Sheets

DUAL NESTED LIQUID CONTAINER

BACKGROUND OF THE INVENTION

1. Field of the Invention

The present invention relates generally to beverage containers, and more particularly, to a beverage container especially adapted for containing two beverages.

2. Description of the Prior Art

Containers for beverages are well known in the prior art. Among those containers, coolers for beverages are also well known in the prior art. For example, the following U.S. patents disclose devices employed for keeping beverages cool: U.S. Pat. Nos. 4,225,059; 4,878,363; 5,009,083; U.S. Pat. No. Des. 259,320; and U.S. Pat. No. Des. 309,238. More specifically, U.S. Pat. No. 4,225,059 discloses a road traveling trailer that includes two kegs of beer placed side by side in the trailer. The beer is cooled before being dispensed. Placing containers side by side uses up a considerable amount of space. In this respect, it would be desirable if a beverage container device were provided that enabled cooling of two beverages without employing two containers placed side by side.

More specifically, U.S. Pat. No. 4,878,363 discloses a hand-carrier cooler that includes an insertable inner chamber that contains ice. The ice keeps a beverage in an outer container cool with diluting the beverage in the outer container when the ice in the inner chamber melts. The inner chamber is not disclosed as containing a consumable beverage. No access is provided to the inner chamber for dispensing a liquid. In this respect, it would be desirable if a beverage container device were provided that had an inner chamber and an outer chamber, both of which contained cooled beverage and both of which had spouts for dispensing the respective cooled beverages. The other patents also disclose beverage containers that do not provide two beverage compartments for cooling two beverages and two spouts for dispensing two respective beverages.

For a liquid container that would contains two liquid storage and dispensing compartments, it would be desirable if a single lid were provided to cover both compartments at the same time.

When liquids are dispensed from a container, to assure a steady flow of liquid, air must replace the liquid that is dispensed. Most times air can freely enter a container when the lid is removed. However, it would be desirable if air can replace liquid dispensed from a container without removing the lid of the container.

There are times when it would be desirable to heat up a beverage that is stored in a container. In this respect, it would be desirable if a beverage container device were provided which included means for heating up a liquid in the container.

There are times when a liquid container is taken to a location where musical entertainment is also desired. In this respect, it would be desirable if a liquid container were provided that included provisions for carrying a compact disk (CD) player and speakers.

Thus, while the foregoing body of prior art indicates it to be well known to use containers for cooling beverages, the prior art described above does not teach or suggest a dual nested liquid container apparatus which has the following combination of desirable features: (1) enables cooling of two beverages without employing two containers placed side by side; (2) has an inner chamber and an outer chamber, both of which contain cooled beverage and both of which have spouts for dispensing the respective cooled beverages; (3) include means for heating up a liquid in the container; (4) has a single lid to cover both compartments at the same time; (5) permits air to replace liquid dispensed from a container without removing the lid of the container; and (6) carries a compact disk (CD) player and speakers. The foregoing desired characteristics are provided by the unique dual nested liquid container of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved dual nested liquid container which includes an outer container assembly which includes an outer vessel and an outer sispensing valve assembly which projects outward from the outer vessel. An inner container assembly is nested within the outer vessel. The inner container assembly includes an inner vessel and an inner dispensing valve assembly which projects outward from both the inner container assembly and the outer vessel.

A lid assembly includes an inner lid portion and an outer lid portion. The inner lid portion provides coverage for the inner vessel, and the outer lid portion provides coverage for the outer vessel. The inner lid portion is nested within the outer lid portion. An outer connector assembly is connected between the outer container assembly and the outer lid portion for removably connecting the outer lid portion to the outer container assembly. Similarly, an inner connector assembly is connected between the inner container assembly and the inner lid portion for removably connecting the inner lid portion to the inner container assembly. The inner connector assembly may include a threaded portion on the inner lid portion and a complementary threaded portion on the inner vessel.

The inner lid portion includes an inner vent hole for venting the inner container assembly when liquid is dispensed from the inner container assembly through the inner dispensing valve assembly. Similarly, the outer lid portion includes a first outer vent hole for venting the outer container assembly when liquid is dispensed from the outer container assembly through the outer dispensing valve assembly. In addition, the outer lid portion may include a second outer vent hole which is in registration with the inner vent hole, for venting the inner container assembly when liquid is dispensed from the inner container assembly through the inner dispensing valve assembly.

A quantity of insulation material jackets the outer container assembly. An outermost housing wall jackets the quantity of insulation material. A handle may be connected to the outermost housing wall.

An outer connector assembly may include a latch assembly located on the outermost housing wall for latching onto a complementary latch-receiving portion on the outer lid portion. The latch assembly may include a curved flange end for engaging a complementary notch on the outer lid portion. A sealing ring located between the outer lid portion and the outer vessel. The outer container assembly and the inner container assembly are formed as a unified integrated structure.

A base assembly may be located under the outer container assembly and the inner container assembly and supports the outer container assembly and inner container assembly. The base assembly may include a quantity of insulation material located under the outer container assembly and inner container assembly.

An electric heating element assembly may be located beneath the inner vessel and may be supported by the base assembly. The electric heating element assembly heats the inner vessel and contents thereof. A rechargeable battery power source may be connected to the electric heating element assembly and may be supported by the base assembly. The rechargeable battery power source provides electrical energy to the electric heating element assembly.

A quantity of insulation material jackets the outer container assembly. An outermost housing wall jackets the quantity of insulation material, and a compact disk player may be connected to the outermost housing wall. Speakers are supported by the outermost housing wall and are connected to the compact disk player. The speakers are capable of selectively swinging into or out of the outermost housing wall. An on/off switch module, supported by the outermost housing wall, may be connected to the compact disk player for controlling operation of the compact disk player.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved dual nested liquid container which has all of the advantages of the prior art and none of the disadvantages.

It is another object of the present invention to provide a new and improved dual nested liquid container apparatus which may be easily and efficiently manufactured and marketed.

It is a further object of the present invention to provide a new and improved dual nested liquid container apparatus which is of durable and reliable construction.

An even further object of the present invention is to provide a new and improved dual nested liquid container which is susceptible of a low cost of manufacture with regard to both materials and labor, and which accordingly is then susceptible of low prices of sale to the consuming public, thereby making such dual nested liquid container apparatus available to the buying public.

Another object of the present invention is to provide a new and improved dual nested liquid container apparatus which cools two beverages without employing two containers placed side by side.

Still another object of the present invention is to provide a new and improved dual nested liquid container that has an inner chamber and an outer chamber, both of which contain cooled beverage and both of which have spouts for dispensing the respective cooled beverages.

Yet another object of the present invention is to provide a new and improved dual nested liquid container which has means for heating up a liquid in the container.

Even another object of the present invention is to provide a new and improved dual nested liquid container apparatus that has a single lid to cover two compartments at the same time.

Still a further object of the present invention is to provide a new and improved dual nested liquid container apparatus which permits air to replace liquid dispensed from a container without removing the lid of the container.

Yet another object of the present invention is to provide a new and improved dual nested liquid container that carries a compact disk (CD) player and speakers.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
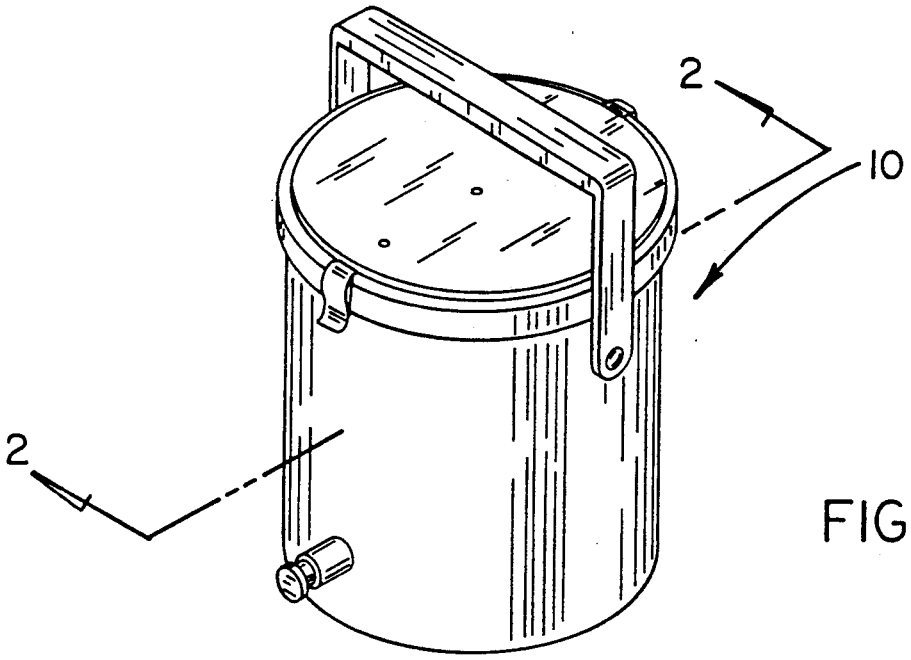
FIG. 1 is a perspective view in elevation showing a first preferred embodiment of the dual nested liquid container of the invention.
Figure 2:
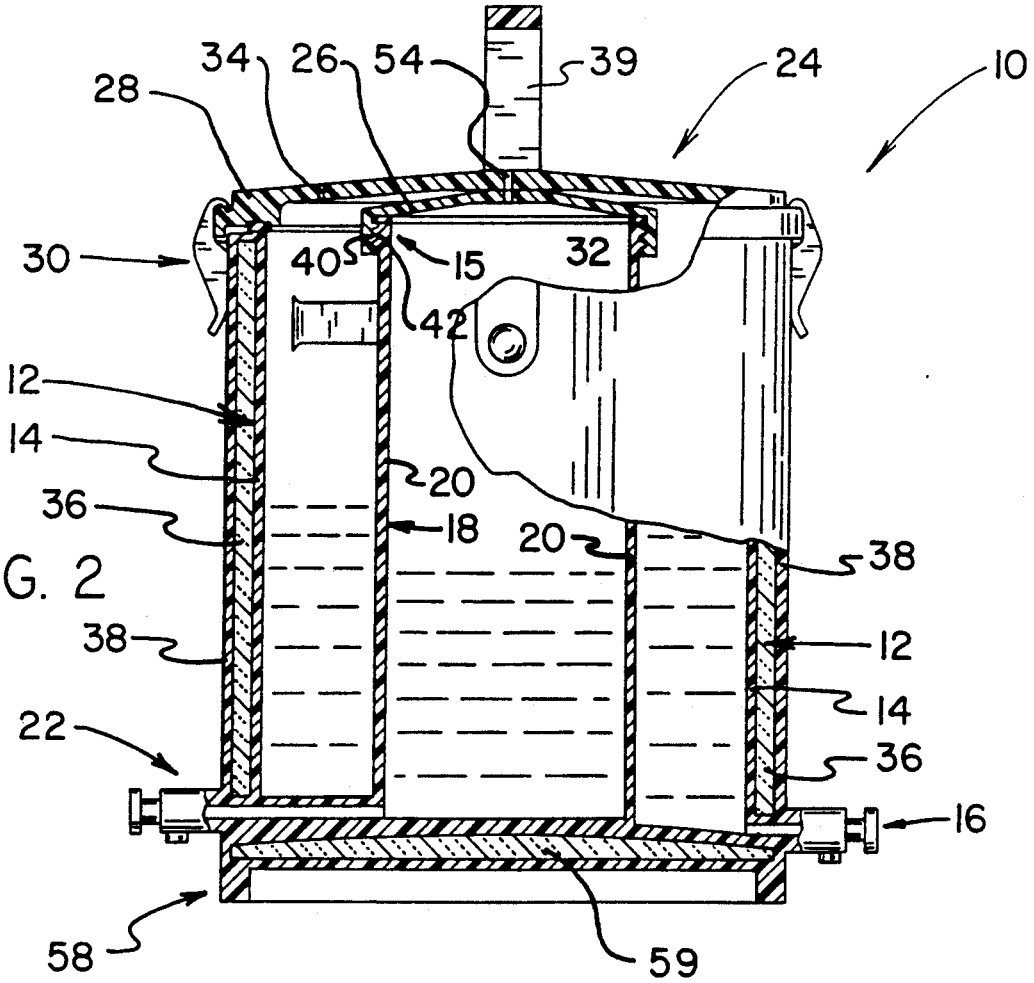
FIG. 2 is a cross-sectional view of the embodiment of the dual nested liquid container apparatus shown in FIG. 1 taken along line 2—2 of FIG. 1.
Figure 3:
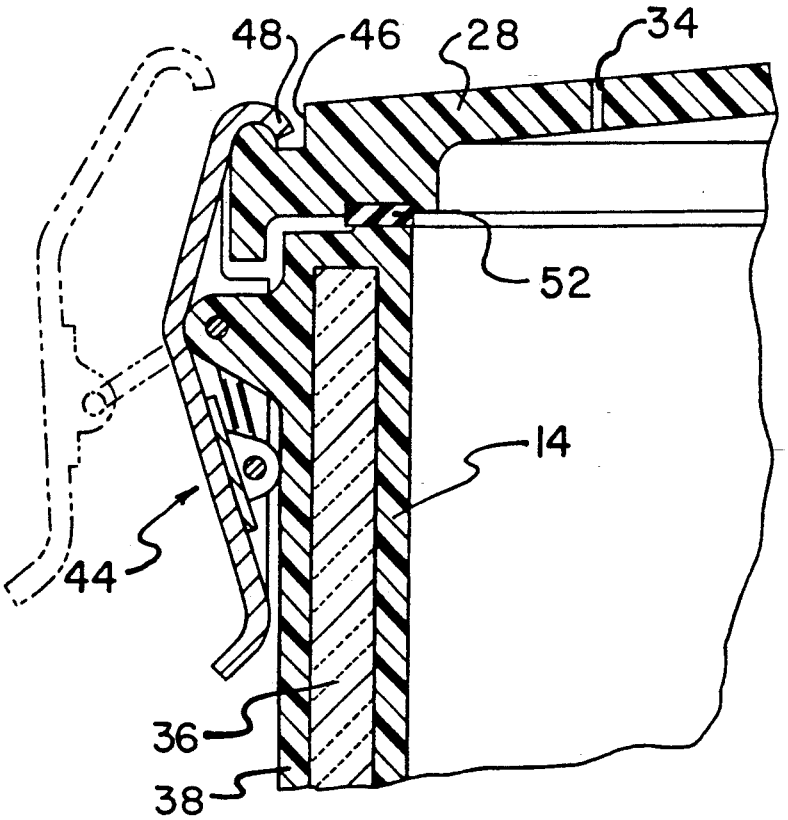
FIG. 3 is an enlarged, partial cross-sectional view of a lid and latch mechanism shown in FIG. 2.
Figure 4:
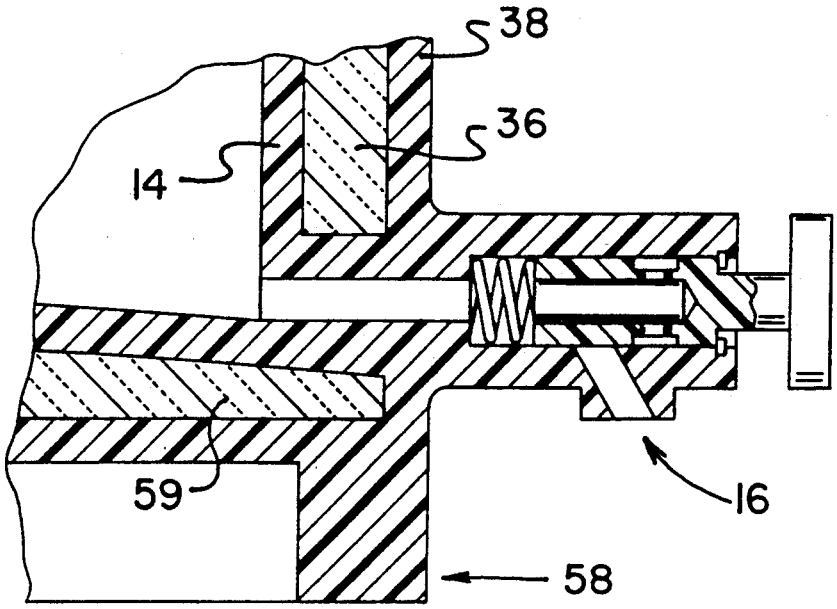
FIG. 4 is an enlarged, partial cross-sectional view of a dispensing valve shown in FIG. 2.

With reference to the drawings, a new and improved dual nested liquid container embodying the principles and concepts of the present invention will be described.

Turning initially to FIGS. 1–4, there is shown a first exemplary embodiment of the dual nested liquid container of the invention generally designated by reference numeral 10. In its preferred form, dual nested liquid container 10 includes an outer container assembly 12 which includes a cylindrical outer vessel 14 and an outer dispensing valve assembly 16 which projects outward from the outer vessel 14. A cylindrical inner container assembly 18 is nested within the outer vessel 14. The inner container assembly 18 includes an inner vessel 20 and an inner dispensing valve assembly 22 which projects outward from both the inner container assembly 18 and the outer vessel 14.

A lid assembly 24 includes an inner lid portion 26 and an outer lid portion 28. The inner lid portion 26 provides coverage for the inner vessel 20, and the outer lid portion 28 provides coverage for the outer vessel 14. The inner lid portion 26 is nested within the outer lid portion 28. An outer connector assembly 30 is connected between the outer container assembly 12 and the outer lid portion 28 for removably connecting the outer lid portion 28 to the outer container assembly 12. Similarly, an inner connector assembly 15 is connected between the inner container assembly 18 and the inner lid portion 26 for removably connecting the inner lid portion 26 to the inner container assembly 18. The inner connector assembly 15 includes a threaded portion 40 on the inner lid portion 26 and a complementary threaded portion 42 on the inner vessel 20.

The inner lid portion 26 includes an inner vent hole 32 for venting the inner container assembly 18 when liquid is dispensed from the inner container assembly 18 through the inner dispensing valve assembly 22. Similarly, the outer lid portion 28 includes a first outer vent hole 34 for venting the outer container assembly 12 when liquid is dispensed from the outer container assembly 12 through the outer dispensing valve assembly 16. In addition, the outer lid portion 28 includes a second outer vent hole 54 which is in registration with the inner vent hole 32, for venting the inner container assembly 18 when liquid is dispensed from the inner container assembly 18 through the inner dispensing valve assembly 22.

A quantity of insulation material 36 jackets the outer container assembly 12. An outermost housing wall 38 jackets the quantity of insulation material 36. A handle 39 is connected to the outermost housing wall 38.

An outer connector assembly 30 includes a latch assembly 44 located on the outermost housing wall 38 for latching onto a complementary latch-receiving portion 46 on the outer lid portion 28. The latch assembly 44 includes a curved flange end 48 for engaging a complementary notch 46 on the outer lid portion 28. A sealing ring 52 located between the outer lid portion 28 and the outer vessel 14. The outer container assembly 12 and the inner container assembly 18 are formed as a unified integrated structure.

A base assembly 58 is located under the outer container assembly 12 and the inner container assembly 18 and supports the outer container assembly 12 and inner container assembly 18. The base assembly 58 includes a quantity of insulation material 59 located under the outer container assembly 12 and inner container assembly 18.

Figure 5:
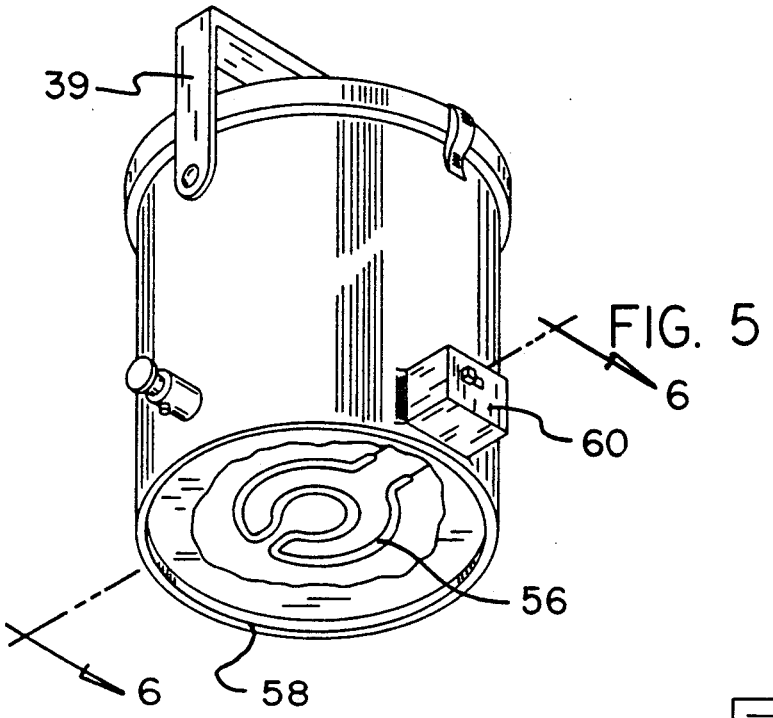
FIG. 5 is a partially broken away perspective view from below of a second embodiment of the dual nested liquid container apparatus of the invention showing a heating element for one of the liquid compartments.
Figure 6:
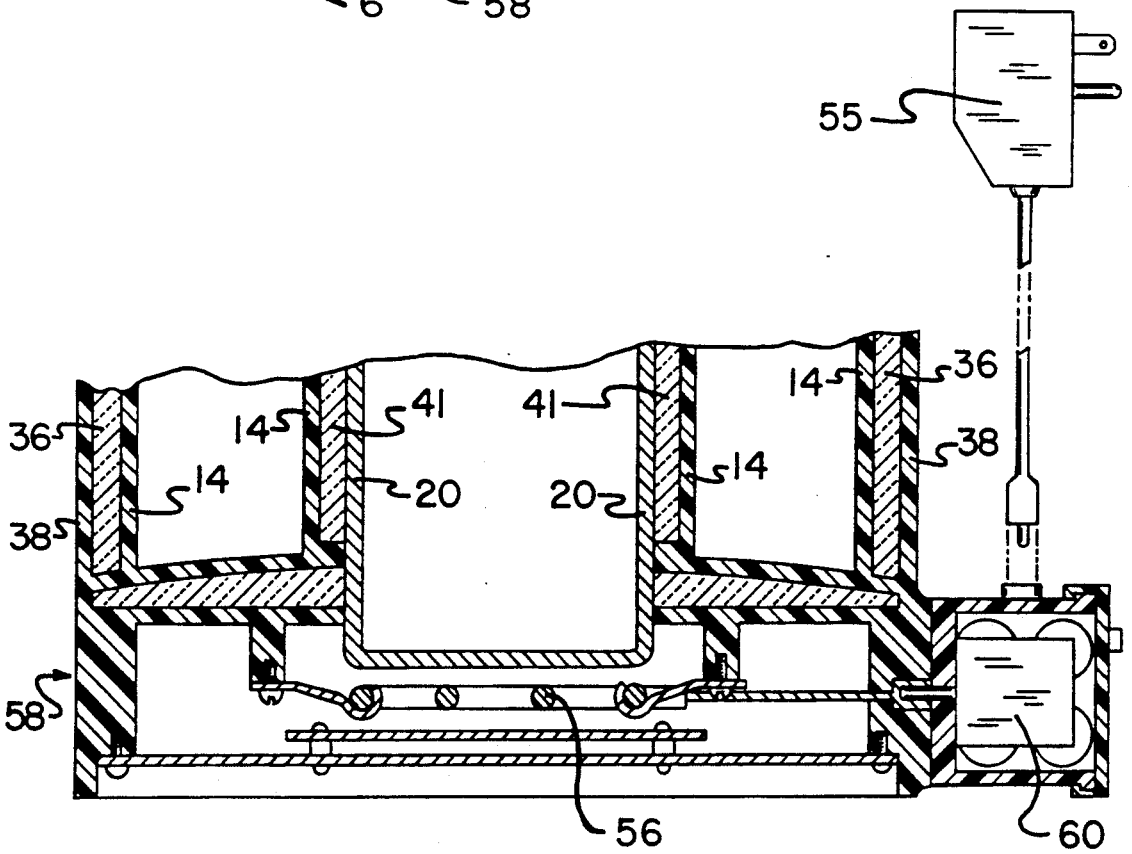
FIG. 6 is an enlarged, partial cross-sectional view of the embodiment of the invention shown in FIG. 5 taken along the line 5—5 thereof.

Turning to FIGS. 5–6, a second embodiment of the invention is shown. Reference numerals are shown that correspond to like reference numerals that designate like elements shown in the other figures. In addition, an electric heating element assembly 56 is located beneath the inner vessel 20 and is supported by the base assembly 58. The electric heating element assembly 56 heats the inner vessel 20 and contents thereof. A rechargeable battery power source 60 is connected to the electric heating element assembly 56 and is supported by the base assembly 58. The rechargeable battery power source 60 provides electrical energy to the electric heating element assembly 56. In FIG. 6, an additional quantity of insulation material 41 is located between outer vessel 14 and inner vessel 20. In FIG. 6, the outer vessel 14 is annular shaped. An AC to DC power supply 55 and converter is shown for recharging the rechargeable battery power source 60.

Figure 7:
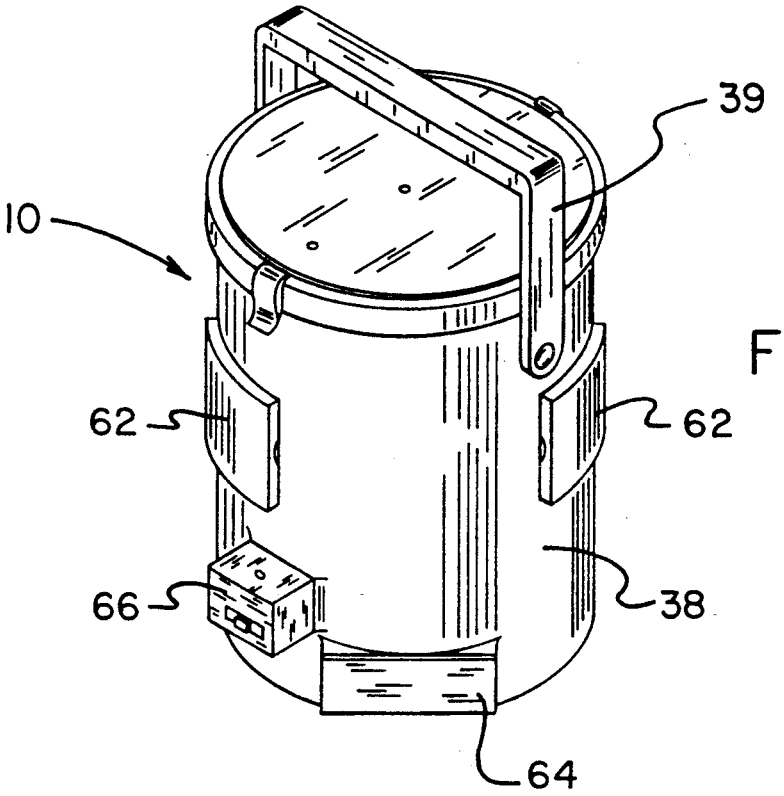
FIG. 7 is a perspective view, in elevation, of a third embodiment of the dual nested liquid container apparatus of the invention showing a built-in CD player and speakers folded into the outer wall of the outer container.
Figure 8:
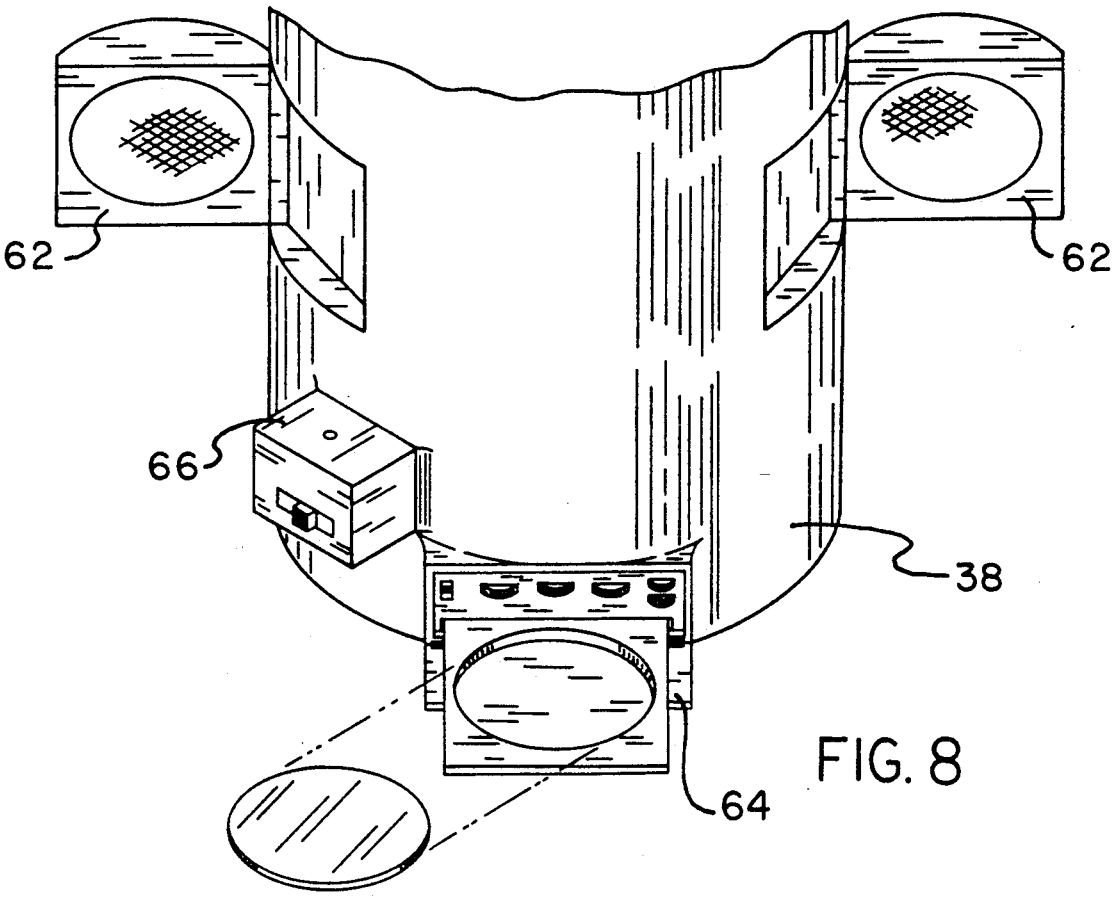
FIG. 8 is an enlarged partial perspective view of the embodiment of the invention shown in FIG. 7 with the speakers folded out of the outer wall of the outer container.

Turning to FIGS. 7–8, a third embodiment of the invention is shown. Reference numerals are shown that correspond to like reference numerals that designate like elements shown in the other figures. In addition, a compact disk player 64 is connected to the outermost housing wall 38. Speakers 62 are supported by the outermost housing wall 38 and are connected to the compact disk player 64. The speakers 62 are capable of selectively swinging into or out of the outermost housing wall 38. An on/off switch module 66, supported by the outermost housing wall 38, is connected to the compact disk player 64 for controlling operation of the compact disk player 64.

The components of the dual nested liquid container apparatus of the invention can be made from inexpensive and durable metal and plastic materials.

The inner compartment can contain a beverage that is to be cooled but that is not to be diluted by melting ice. Such a beverage may be tea, cola drink, or juice, and the like. The outer compartment may contain a beverage that can readily be diluted with melting ice. Such a beverage can be ice water.

In one preferred embodiment, the inner compartment has a two quart capacity, and the outer compartment has a one and one-half gallon capacity. In another preferred embodiment, the inner compartment has a two gallon capacity, and the outer compartment has a three and one-half gallon capacity.

It is apparent from the above that the present invention accomplishes all of the objects set forth by providing a new and improved dual nested liquid container apparatus that is low in cost, relatively simple in design and operation, and which may advantageously be used to cool two beverages without employing two containers placed side by side. With the invention, a dual nested liquid container is provided which has an inner chamber and an outer chamber, both of which contain cooled beverage and both of which have spouts for dispensing the respective cooled beverages. With the invention, a dual nested liquid container apparatus is provided which has means for heating up a liquid in the container. With the invention, a dual nested liquid container apparatus is provided which has a single lid to cover two compartments at the same time. With the invention, a dual nested liquid container is provided which permits air to replace liquid dispensed from a container without removing the lid of the container. With the invention, a dual nested liquid container apparatus is provided which carries a compact disk (CD) player and speakers.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved dual nested liquid container, comprising:

an outer container assembly including an outer vessel and an outer dispensing valve assembly which projects outward from said outer vessel, an inner container assembly nested within said outer vessel, said inner container assembly including an inner vessel and an inner dispensing valve assembly which projects outward from said inner container assembly and outward from said outer vessel, a lid assembly which includes an inner lid portion and an outer lid portion, said inner lid portion providing coverage for said inner vessel and said outer lid portion providing coverage for said outer vessel, said inner lid portion being nested within said outer lid portion, outer connector assembly means, connected between said outer container assembly and said outer lid portion, for removably connecting said outer lid portion to said outer container assembly, and inner connector assembly means, connected between said inner container assembly and said inner lid portion, for removably connecting said inner lid portion to said inner container assembly, wherein said inner lid portion includes an inner vent hole for venting said inner container assembly when liquid is dispensed from said inner container assembly through said inner dispensing valve assembly, wherein said outer lid portion includes a first outer vent hole for venting said outer container assembly when liquid is dispensed from said outer container assembly through said outer dispensing valve assembly, and wherein said outer lid portion includes a second outer vent hole, in registration with said inner vent hole, for venting said inner container assembly when liquid is dispensed from said inner container assembly through said inner dispensing valve assembly.

2. The apparatus described in claim 1 wherein said inner connector assembly means include a threaded portion on said inner lid portion and a complementary threaded portion on said inner vessel.

3. The apparatus described in claim 1, further including:

a quantity of insulation material jacketing said outer container assembly.

4. The apparatus described in claim 3, further including:

an outermost housing wall jacketing said quantity of insulation material.

5. The apparatus described in claim 3, further including a handle connected to said outermost housing wall.

6. The apparatus described in claim 3 wherein said outer connector assembly means include a latch assembly located on said outermost housing wall for latching onto a complementary latch-receiving portion on said outer lid portion.

7. The apparatus described in claim 9 wherein said latch assembly includes a curved flange end for engaging a complementary notch on said outer lid portion.

8. The apparatus described in claim 1, further including:

a sealing ring located between said outer lid portion and said outer vessel.

9. The apparatus described in claim 1 wherein said outer container assembly and said inner container assembly are formed as a unified integrated structure.

10. The apparatus described in claim 1, further including:

a base assembly, located under said outer container assembly and said inner container assembly, for supporting said outer container assembly and inner container assembly.

11. The apparatus described in claim 13 wherein said base assembly includes a quantity of insulation material located under said outer container assembly and inner container assembly.

* * * * *